United States Patent [19]

Shay

[11] 3,997,086

[45] Dec. 14, 1976

[54] PUMP FOR SPRAY DISPENSER AND THE LIKE

[75] Inventor: Joseph John Shay, Manchester, N.H.

[73] Assignee: Summit Packaging Systems, Inc., Londonderry, N.H.

[22] Filed: Aug. 25, 1975

[21] Appl. No.: 607,251

[52] U.S. Cl. ..... 222/385; 239/333

[51] Int. Cl.[2] ..... B67D 5/42

[58] Field of Search ..... 222/383–385, 222/400.5, 400.8, 401, 402.24, 333; 239/333, 331, 579; 417/502, 550

[56] References Cited

UNITED STATES PATENTS

| | | | |
|---|---|---|---|
| 3,640,470 | 2/1972 | Susuki | 222/385 X |
| 3,724,726 | 4/1973 | Susuki | 222/385 |
| 3,865,313 | 2/1975 | Kondo | 239/333 |

*Primary Examiner*—Allen N. Knowles
*Assistant Examiner*—Stan L. Stack, Jr.
*Attorney, Agent, or Firm*—Dallett Hoopes

[57] ABSTRACT

Pump for spray dispenser has spring-pressed annular piston serving as an accumulator and controlling flow through the pump discharge so that no discharge passes unless and until pressure within the pump housing is sufficiently high.

11 Claims, 13 Drawing Figures

PUMP FOR SPRAY DISPENSER AND THE LIKE

BACKGROUND OF THE INVENTION

1. Field of the Invention

This invention relates to a pump for liquid-dispensing containers and the like. More specifically in a preferred embodiment, this invention relates to a finger-operated pump as used on hand-held liquid-spray-dispensing containers.

2. Description of the Prior Art

In the prior art there are a large variety of pump-type dispensers used on hand-held containers of liquid and adapted upon being reciprocated by finger pressure to pump liquid up from the bottom of the container out through a spray nozzle or mechanical break-up button. The bulk of these devices are not concerned with developing pressure within the pump before dispensing commences to develop an effective spray: rather the user is instructed to operate the pump in "quick, short strokes", assuming that if the strokes are quick enough, pressure will be sufficient to develop an adequate spray.

There has been at least one attempt in the prior art to assure that the pressure built up within the pump was adequate prior to the discharge of liquid to the spray head. This is shown in the U.S. Pat. No. 3,865,313 which issued Feb. 11, 1975 to Kondo. In this structure, the pump plunger is encircled by an annular piston which is spring-biased downwardly so that as the plunger descends, displacing liquid, pressure is built up against the spring-biased piston in a kind of "accumulator" effect. Subsequently, a discharge valve is mechanically actuated when the plunger is at the bottom of the stroke causing the liquid to dispense out and create a spray in the head mounted at the top of the plunger.

A disadvantage of a mechanically actuated discharge valve is that the discharge will occur whether or not sufficient pressure has built up because the opening of the discharge valve is contigent only on the plunger reaching the "down" position. This means that it is possible for the pressure build-up to not be sufficient to form a spray as the liquid passes through the break-up button. Discharge may therefore be in the form of a squirt or thin stream of liquid rather than a spray.

In addition, and even when the plunger is depressed in a "quick, short stroke", the pressure at the spray head will drop upon completion of the downstroke to essentially zero because the discharge valve in such a structure remains open until the plunger starts its upward stroke. This can result in poor atomization at the end of the downstroke.

SUMMARY OF THE PRESENT INVENTION

Under the present invention, there is created an "accumulator" effect in that the pressure built up in the pump operates against the spring-pressed piston. However, in the present invention, the piston itself actuates the discharge valve port so that discharge is possible only when and if pressure within the pump chamber is sufficient to raise the piston above the discharge valve port. This assures that all liquid will reach the spray head at sufficient pressure to emerge therefrom in spray form, and eliminates the possibility of liquid emerging as a thin stream or squirt.

The invention also includes means for positively sealing the top of the container when the plunger is in the up position. This means that there will be no leakage of the unit when it is not in use.

Additionally, the finger-operated pump of the present invention is ideally suited for mounting in place of a conventional aerosol valve in an aerosol-type can so that such a can, economically produced, can be used without the need for the conventional aerosol propellant. The pump of the invention is equally well adapted to the bottle-type container with plastic cap.

BRIEF DESCRIPTION OF THE DRAWINGS

Further objects and features of the invention will be apparent from the following description and the accompanying drawings, all of which disclose non-limiting embodiments of the invention. In the drawings.

DESCRIPTION OF THE PREFERRED EMBODIMENT

Figures 1, 2, 3, 4, 5, 6:
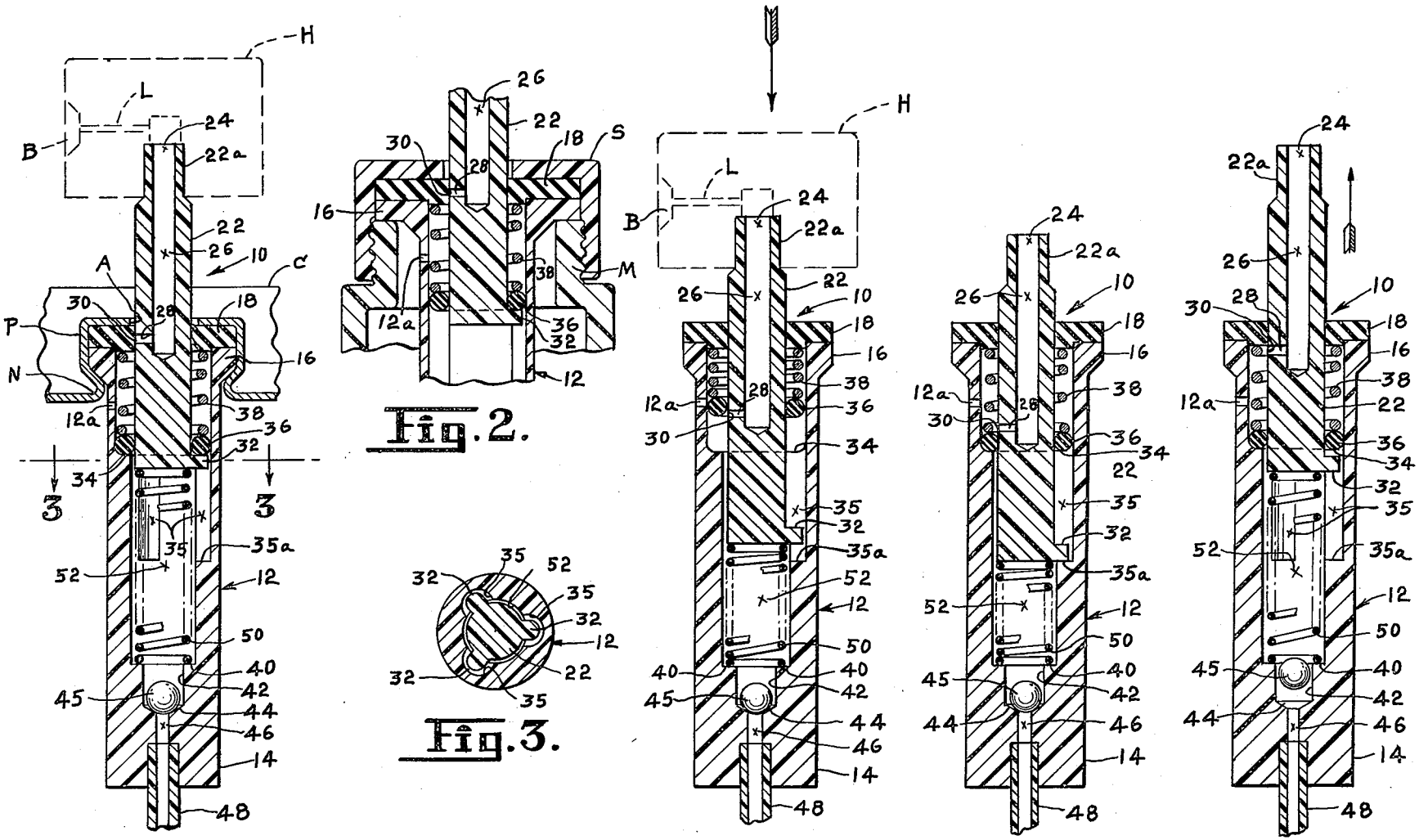
FIG. 1 is a sectional view of a pump embodying the invention shown installed on a hand-held container of the metal aerosol type. A spray head on the pump is shown in phantom.
FIG. 2 is a fragmentary view showing the upper portion of a pump as in FIG. 1, in profile adapted to a glass-bottle-type container with plastic cap.
FIG. 3 is a sectional view taken on the line 3—3 of FIG. 1.
FIGS. 4, 5 and 6 are sequential views showing the operation of the pump of FIG. 1. The head is shown in phantom only in FIG. 4.

A preferred embodiment of the invention is shown in FIG. 1 and is generally designated 10. It comprises a tubular housing 12 having a vent **12*a*, closed lower end 14 and an outward annular flange 16 around the upper end thereof. The housing also includes a gasket 18 of resilient material across the upper end of the tubular housing 12 and held against the flange 16**. The parts thus far described are clamped into a conventional valve mounting pedestal P of an aerosol-type container C. The clamping is effected by neck N.

In the FIG. 2 adaptation the same parts, gasket 18 and flange 16, are enlarged slightly and clamped between the mouth M and screw cap S of a bottle-type container.

The pedestal P, as shown in FIG. 1, has an aperture A which receives the upper end of a plunger 22. As shown, the upper end of the plunger may be reduced as at **22*a* and is provided with a central discharge opening 24. The discharge opening 24 is the termination of an axial passage 26 at the lower end of which a radial conduit 28 is formed presenting a discharge inlet port 30** on the side of the plunger.

The lower end of the plunger is formed with a plurality of outwardly extending feet 32 (FIG. 3).

Extending inwardly from the wall of the tubular body is a shoulder 34 which faces upwardly and serves as a bottom stop for an annular piston 36 which is sealably and slideably disposed about the plunger 22. Preferably, the "piston" is in the form of a conventional "O-ring". The annular piston 36 also sealably and slideably engages the adjacent wall of the tubular housing 12.

Compressively disposed between the annular piston 36 and the gasket 18 is biasing means comprising the spring 38, which urges the piston 36 downward to seat on the shoulder 34.

As best shown in FIG. 3, the wall of the tubular housing 12 is thickened below the shoulder 34 but is formed with a plurality of preferably uniformly disposed longitudinal grooves 35 thereat. It is in these grooves that the feet 32 are permitted to reciprocate. The grooves terminate at their lower ends in ledges 35*a*.

The lower end 14 of the tubular housing 12 is formed with an annular ledge 40 from which there is a central recess 42 having a funnel-shaped entry 44 from an inlet passage 46. A check valve ball 45 is normally seated on the surface of the entry 44. The inlet passage may be connected to a dip tube 48, as shown, the dip tube extending downward to draw liquid from the container.

A second spring 50 is provided, and its lower end seats on the shelf 40 while its upper end engages the lower end of the plunger 22. This normally causes the plunger to move toward the position shown in FIG. 1 wherein the upper surface of the feet 32 disposed in the grooves 35 butt against the underside of the seated piston 36 to provide an upper limit for the travel of the plunger 22.

As shown, when the plunger is at the upper end of its travel as defined by the engagement of the feet 32 against downwardly-pressed piston 36, the radial conduit 28 is aligned with the center of a resilient gasket 18 serving to seal off further discharge through passage 26.

Additionally as shown, the upper end 22*a* of the plunger 22 has fitted thereover a discharge head H which is provided with a passage L communicating with the opening 24 and leading to a break-up button B by which the liquid moving through the head is broken up into a spray.

OPERATION

As shown in FIGS. 4, 5, and 6, the operation of a pump embodying the invention is relatively simple. Assuming in FIG. 4 that the chamber 52 defined by the tubular housing 12 is filled with liquid from a previous stroking of the pump, the head H of the pump is depressed by finger pressure from the position shown in FIG. 1 to that shown in FIG. 4. The plunger 22 is, of course, depressed against the upward urging of the spring 50. Thus, the lower end of the plunger 22 moves into the chamber and displaces liquid therefrom. This causes liquid to move up the annular space between housing 12 and the plunger 22 and the increased pressure to drive up the piston 36, as shown, against the force of the spring 38.

The plunger, moving downward, will bring the port 30 into alignment with and barely pass the ascending piston 36. This cracks open the discharge valve, so to speak, and permits the pressured liquid about the plunger below the piston 36 to shoot into the discharge port 30, through passages 28 and 26 and out the discharge opening 24 into the head H. As the liquid surges through the break-up button B, it travels with sufficient pressure and velocity to be broken up into a fine spray by the button.

It should be noted that prior to the plunger arriving at the position shown in FIG. 4, the port 30 was disposed above the piston 36 to permit the inflow of air through the head, passages 26, 28 and outlet 30 into the annular space surrounding the plunger above the piston 36 and into the container C through vent 12*a*. This breaks any vacuum that might arise in the container due to the withdrawal of liquid from the container.

Referring now to FIG. 5, the plunger 22 is shown at the end of its downstroke, with feet 32 bottomed on ledge 35*a*. It will be understood that the piston 36, after the discharge port 30 is opened, has traveled downwardly with the plunger. This is because the pressure in the housing has continued to drop as liquid discharges and the piston is driven down by spring 38. Eventually in their downward race, the piston "outruns" the port 30 and closes it off, stopping discharge. This occurs shortly before the plunger bottoms out (FIG. 5). Thus, the port 30 is only open for that small portion of the downstroke during which the pressure in the housing is sufficient to keep the piston 36 above the descending port 30.

It will be noted that in FIG. 5 the piston 36 has reached the shoulder 34 and rests thereon thereafter during the entire upstroke of the plunger. There exists no positive pressure in the housing during the upstroke.

FIG. 6 shows the plunger, approaching the top of its stroke, being driven upward by the spring 50. It will be noted that the port 30 being above the piston 36, permits atmosphere to move into the annular chamber above the piston and out through the vent port 12*a* to break any vacuum in the container.

It will also be noted that on the upstroke, that is, from the position of the plunger in FIG. 5 up to the plunger position shown in FIG. 6 and until the plunger 22 reaches its uppermost position where the feet 32 engage the underside of piston 36 (FIG. 1), there is created a negative pressure in the chamber 52 drawing liquid from the inlet passage 46 past the ball 45 and into the chamber 52, ready for the next stroke. At the top of the unstroke, the ball 45 drops, seating on the funnel-shaped entry or seat 44. This drawing in of liquid effected by the raising of the plunger 22 assures that a supply of liquid will be ready for discharge during the next downstroke of the plunger 22.

It will now be seen that with the structure embodying the invention, discharge out the port 30 will be effected only when and if during the downstroke the pressure in the housing exceeds the pressure necessary to lift the piston 36 above the port 30 to crack it open. Discharge at this pressure, which pressure may be preestablished by careful selection of the spring 38, assures that the velocity of the fluid in the button B is sufficient to create a quality of atomization of liquid as is desired. Reasons why pressure in the housing may not reach the preestablished pressure are many, including insufficient liquid in the housing and insufficient speed of stroke. The structure disclosed, in other words, assures good spray every time and makes unnecessary the admonishment "use quick, short strokes". Every time the disclosed structure discharges, it will discharge with sufficient velocity and pressure to create a good spray.

MODIFICATION

A modification of the embodiment disclosed in FIGS. 1 through 6 inclusive is shown in FIGS. 7 through 12. In the modified structure, the form is quite similar to that of the above-described embodiment and for that reason, in many cases the primed form of the same reference numeral has been used to designate parts corresponding to numbered parts in the earlier embodiment.

Referring more specifically to the structure of the modification (FIGS. 7 through 12), the pump shown is designated 10'. It comprises a tubular body 12' having a closed lower end 14'. The upper end of the body 12' is formed with an outward flange 16' which is superposed by an annular gasket 18'. A plunger 22' having a stem 22a' extends upward in sealing engagement through the gasket 18'. A metal or plastic washer 19 loosely receiving the upper end of the plunger is formed with a central downward annular seat 19a which engages the upper surface of gasket 18' about the opening therein. Washer 19 has ribs 19b radiating out from the seat 19a. Aligned vertical grooves 16a and 18a are formed in the periphery of the flange 16' and gasket 18' respectively. These grooves permit passage of vent air from between the ribs 19b of the washer 19, as will be explained.

Figures 7, 8, 9, 10, 11, 12, 13:
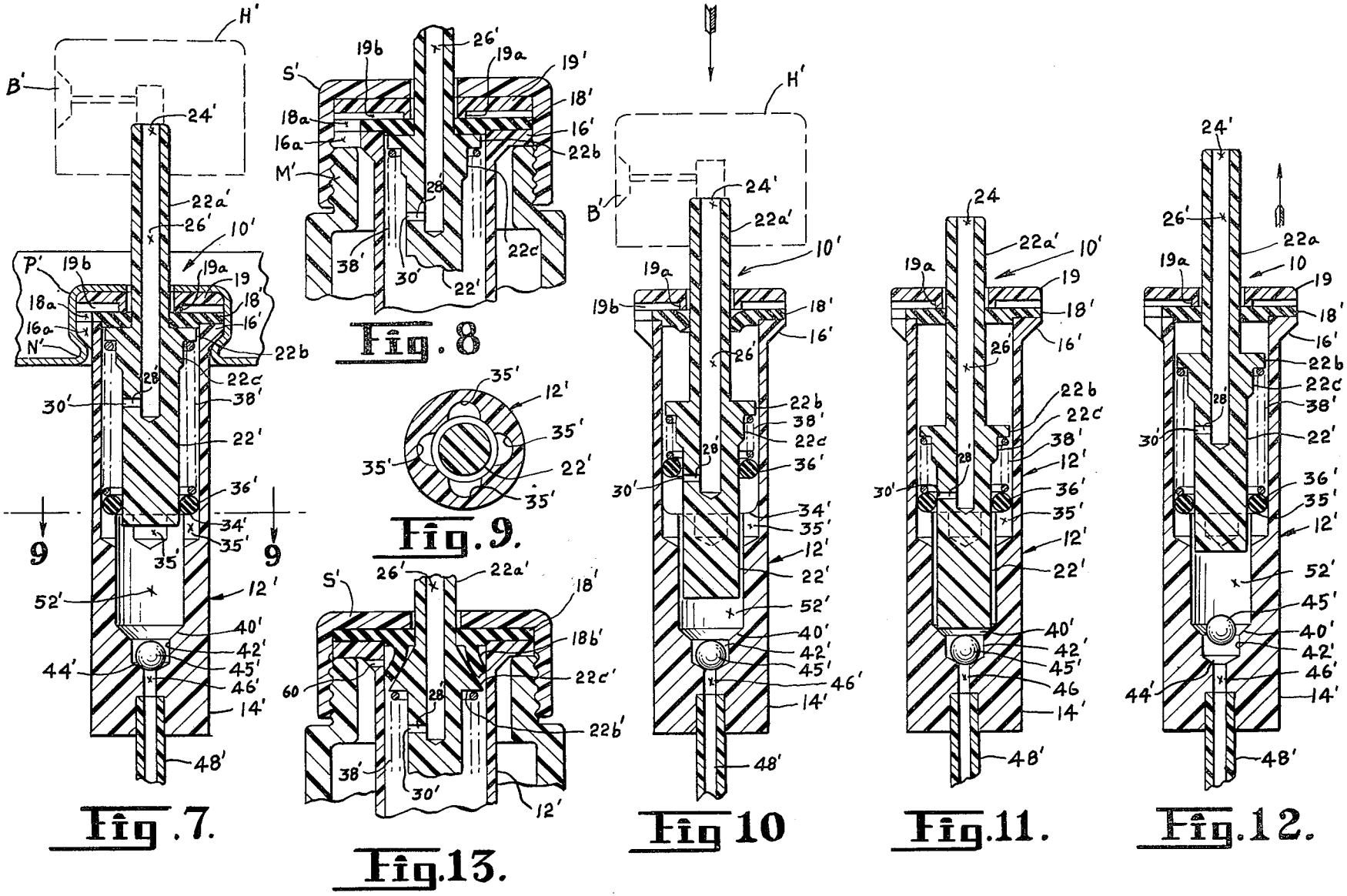
FIG. 7 is a sectional view of a modified form of pump embodying the invention shown installed on a hand-held container of the metal aerosol type. The head is show in phantom.
FIG. 8 is a fragmentary view showing the upper portion of a pump as in FIG. 7 in profile adapted to a glass-bottle-type container with plastic cap.
FIG. 9 is a sectional view taken on the line 9—9 of FIG. 7.
FIGS. 10, 11 and 12 are sequential views showing the operation of the pump disclosed in FIG. 7. The head is shown in phantom only in FIG. 10.
FIG. 13 is a fragmentary view showing the upper portion of a pump as shown in FIG. 8 and providing vent means back into the container for liquid product which has "blown by" the piston.

The above-described parts in FIG. 7 are clamped into a conventional aerosol-type container C having valve pedestal B' with neck N'.

In FIG. 8, the above-described parts are adapted as shown and clamped between the cap S' and mouth M' of a bottle-type container having a plastic screw cap. In the FIG. 8 adaptation, the flange 16', gasket 18', and washer 19' are all enlarged in diameter, and both the flange and the gasket are formed with spaced vertical grooves 16a and 18a to permit the passage of vent air from the spaces between the ribs 19b of the washer 19' during the venting process to be described. To be effective, the grooves have to be deeper than the inside surface of the mouth M of the bottle. Washer 19 is formed with seat 19a. Obviously, washer 19' may be integral with the cap S. Or, in other words, the undersurface of the top wall of the cap may be formed with the seat 19a and ribs 19b.

The plunger 22 (FIG. 7) is shown with an outward flange 22b disposed just below the gasket 18'. An enlargement 22c of the plunger below the flange 22b serves to center the upper end of the spring 38' and give strength to the flange 22b. As shown, at the upper limit of travel of the plunger 22', the flange 22b serves to press the gasket 18' against the annular downward seat 19a assuring a leakproof relation between the gasket 18' and the seat 19a. This sealing structure and operation is well known in the art.

As shown in phantom, the upper end of the stem 22a' may be provided with a head H, as in the earlier embodiment, connected in manners well known in the art and provided with a spray break-up button B' as described.

The tubular housing 12' is provided intermediate its ends with an inward shoulder 34' having therebelow uniformly spaced longitudinal grooves 35' (FIG. 9). Slidably and sealingly circumposing the lower end of the plunger 22' and sealingly engaging the inside surface of the wall of the housing 12' is the annular piston 36' which may be in O-ring form.

As noted above, the spring 38' is centered by the enlargement 22c and is disposed compressively between the flange 22b at its upper end and the piston 36' at its lower end. This urges the plunger 22' up and the piston down to the lower limit of its travel: its seating on the shoulder 34'. A discharge port 30' is formed in the plunger 22' above the piston 36' (FIG. 7). From the port 30', a radial passage 28' is formed inward of the plunger and meets the axial passage 26' which is formed upwardly to the discharge opening 24'.

The lower end 14' of the housing 12' is formed with a shoulder 40' and a central downward recess 42' therefrom terminating in a funnel-shaped entry 44' into an inlet passage 46' which may be connected to a conventional dip tube 48', as described. A ball 45', preferably of metal, is disposed in the recess 42' and serves, when it is in its downward position resting on the entry 44', as a check to block the drainage of liquid in the pumping chamber 52' back down the outlet 46'.

OPERATION OF THE MODIFICATION

From the at-rest position shown in FIG. 7 wherein the spring 38' working in compression holds the piston 36' and the plunger 22' in the positions shown, the plunger is moved down by finger pressure on the head H'.

In FIG. 10, it will be noted that the plunger has advanced downward so that its lower end displaces considerable liquid in the pumping chamber thereby increasing the liquid pressure in the housing and forcing the piston 36' upwardly off its shoulder 34'. In FIG. 10, the ascending piston 36' has risen to a position slightly above the descending discharge port 30' permitting a flow of liquid out through the cracked open port 30', through passages 28' and 26' and the outlet opening 24'.

Subsequent to the position shown in FIG. 10 and while the plunger is on its continued downstroke, the piston 36', because of the dropping pressure, rides downwardly on the plunger just above the port 30' still permitting liquid to move through the port and up through the stem 22a' to discharge. This operation is as with the earlier embodiment. As the plunger approaches the bottom of its stroke, the continuing discharge of liquid through the port 30' causes the pressure in the chamber to drop so that the pressure is no longer able to hold the piston 36' above the port 30'. The piston drops below the port, closing it off. In the FIGS. 7–13 version, the downward urging of the piston is intensified by the increased spring pressure due to the lowering of the top of the spring as flange 22b comes down. The lowering of the upper end of the spring is a characteristic of the FIGS. 7–12 embodiment. While the structure of FIGS. 7–12 is operable and meritorious, the two-spring version of FIGS. 1–6 is preferred because the provision of two separate springs affords greater selectability in the piston-opposing force and the plunger-return force.

At the bottom of the downstroke (FIG. 11), the piston returns to seat on its shoulder 34'. It is to be noted that the lower end of the plunger 22' bottoms out on sloping shoulder 40'.

There follows the upstroke during which the piston 36' is seated on the shoulder 34' and the raising plunger 22' driven by the spring 38' creates a negative pressure in the chamber 52' causing liquid to be drawn upward from the inlet passage 46' raising the ball 45'. This assures that there will be a supply of liquid in the housing for the next downstroke.

Further features of the FIGS. 7–12 embodiment are to be noted. In FIG. 10, on the downstroke the downward drag of the stem 22a' on the inner circumference of the gasket 18' pulls the center of that gasket downwardly off its seat 19a, so to speak. This permits air from the atmosphere to pass under the seat 19a and through the radial passages between ribs 19*b*, the vertical grooves 16*a* and 18*a* in the gasket 18′ and flange 16′, and into the container. This breaks any vacuum which may have arisen on previous strokes of the pump due to removal of the liquid from the container. This automatically assures the equilibrium of the air pressure inside the container and atmosphere, and eliminates the possibility of vacuum being built up inside the container to impede the proper discharge and functioning of the pump. The feature is shown in both the FIG. 7 and FIG. 8 modifications, and may be used in the FIGS. 1–6 modification in place of vent 12*a*, if desired. It will be noted that on the upstroke, the gasket 18′ is permitted to move back to its position wherein it seats on the annular downward boss or seat 19*a*, and that when the plunger is at the top of its upstroke, the flange 22*b* urges the resilient gasket up into close seating contact to avoid leakage thereafter.

In the FIG. 13 modification, a vent opening 60 is provided in the side wall of the housing 12′ to permit the escape back into the container of liquid which has "blown-by", so to speak, the piston 36′. The underside of the gasket 18′ is formed with an integral downward resilient annular skirt 18*b*′. In this embodiment, the plunger stem 22*a*′ is formed with a conical surface 22*c*′ above the flange 22*b*′. The surface, at the top of the plunger stroke bells the skirt 18*b*′ outward so that the distal end of the skirt engages and seals against the side wall of the housing 12′ below the vent 60. This effectively seals the housing against flow of liquid from the container into the housing by way of vent 60 when the container is inverted. Obviously, this permits escape of "blown-by" liquid and precludes further build-up of liquid in the housing which could lead to leakage about or through the stem 22*a*′. In addition, the structure permits equalizing of pressure inside the container C with atmosphere. It will be noted that in all positions of the plunger other than that shown, vent 60 connects the inside of housing 12 above the piston with the container C outside the pump. Thus, when the plunger is depressed and the port 30′ is above the piston, air from atmosphere can move down the passages 26′, 28′, through port 30′, into the pump chamber and through vent 60 to equalize with the atmosphere any vacuum build-up in the container due to withdrawal of liquid.

It should be clear from the above description that the invention offers extremely simple structures which not only assure a leakproof dispensing container but also assures that any discharge from the pump will be of sufficient pressure and velocity to generate a spray as it passes through the mechanical break-up of the associated actuating head.

While the invention has been shown in but a limited number of embodiments, it is not so limited but is capable of many variations, all falling within the scope of the following claim language and equivalents thereof.

I claim:

1. A pump for a liquid-spray-type dispensing container comprising: a tubular housing adapted to be held in the mouth of the dispensing container, the housing having a bottom wall with an inlet opening adapted to communicate with the bottom of the container and including an annular resilient gasket across its upper end, a plunger extending down into the housing and encompassed by the gasket in sealing fashion at least at the top of the plunger stroke, the plunger having a discharge port in its side and a discharge opening above the port and outside the housing, passage means in the plunger connecting the port and discharge opening, annular piston means slideably and sealingly engaging both the plunger and the inside of the housing, biasing means urging the piston means downward and the plunger means upward, first stop means limiting the upward travel of the plunger, second stop means on the housing limiting the downward movement of the piston means, blocking means closing the inlet opening to flow of liquid back through the inlet opening, whereby when the plunger is moved downward in the housing discharge through the passage commences only when and if the pressure in the housing becomes sufficient to raise the piston means above the port on the plunger and discharge terminates thereafter when the pressure falls and permits the piston means to move below the port.

2. A pump for a hand-held liquid dispensing container as claimed in claim 1 wherein stop means for the plunger includes outward flange on the plunger which, at the top of the stroke, engages the gasket means to seal the housing against leakage.

3. A pump for a hand-held liquid dispensing container as claimed in claim 2 wherein biasing means includes a spring encircling the plunger and compressively disposed between the flange and the annular piston.

4. A pump for a hand-held liquid dispensing container as claimed in claim 1 wherein biasing means includes a first spring means encircling the plunger and compressively disposed between the gasket means and the piston and second spring means compressively disposed between the bottom of the plunger and the lower end of the housing.

5. A pump for a hand-held liquid dispensing container as claimed in claim 4 wherein the first spring means is of greater strength than the second spring means.

6. A pump for a hand-held liquid dispensing container as claimed in claim 4 wherein the port is closed by the gasket at the top of the plunger upstroke.

7. A pump for a hand-held liquid dispensing container as claimed in claim 4 wherein the second stop means comprises upward-facing inward shoulder means formed in the wall of the housing intermediate its upper and lower ends.

8. A pump for a hand-held liquid dispensing container as claimed in claim 7 wherein the shoulder means is formed with a cutout and a groove extends along the housing downward from the cutout and the second stop means comprises outward foot means formed on the lower end of the plunger disposed in the groove, the foot means adapted to engage the piston when the same is seated on the shoulder means.

9. A pump for a hand-held liquid dispensing container as claimed in claim 1, the blocking means comprising a tapered entry to the inlet and a ball adapted to rest on and close the entry except when liquid is drawn up through the inlet.

10. A pump for a hand-held liquid dispensing container as claimed in claim 1 wherein an aperture is formed in the side wall of the housing adjacent the gasket and above all working portions of the piston to vent any vacuum created in the container as liquid is removed therefrom.

11. A pump-type dispensing container including a container, a tubular pump housing mounted in the mouth of the container, an annular resilient gasket closing the upper end of the housing, a plunger operative in the housing and passing through the gasket and sealingly engaging the gasket at least at the top of the stroke of the plunger, outlet passage means down through the plunger and having a port opening into the housing, the resilient gasket having a downward skirt about the opening therein and the plunger having an outward surface which at the top of the upstroke of the plunger urges the distal end of the skirt out into sealing engagement with the side wall of the housing in a sealing line, and vent means into the container is provided in the side wall of the housing above the sealing line to permit escape back into the container of liquid from the housing above the piston and to equalize pressure in the container with atmosphere.

* * * * *